United States Patent [19]

Kendall

[11] 4,149,034

[45] Apr. 10, 1979

[54] RESOLUTION ENHANCED SOUND DETECTING APPARATUS

[76] Inventors: Robert A. Frosch, Administrator of the National Aeronautics and Space Administration, with respect to an invention of James M. Kendall, Pasadena, Calif.

[21] Appl. No.: 861,392

[22] Filed: Dec. 16, 1977

[51] Int. Cl.[2] ..... G10K 10/00

[52] U.S. Cl. ..... 179/1 MF; 179/1 DM; 181/148; 340/8 LF

[58] Field of Search ..... 179/1 MF, 1 E, 1 UW, 179/1 DM; 340/8 FT, 8 LF, 8 L; 181/148, 125, 176, 198, 199

[56] References Cited

U.S. PATENT DOCUMENTS

| | | | |
|---|---|---|---|
| 2,155,163 | 4/1939 | Gerlach | 179/1 |
| 2,434,666 | 1/1948 | Mason | 177/336 |
| 2,452,068 | 10/1948 | Peterson | 340/8 FT |
| 2,770,795 | 11/1956 | Peterson | 340/8 FT |
| 3,389,373 | 6/1968 | Angeloff et al. | 340/6 |
| 3,895,188 | 7/1975 | Ingraham | 179/1 MF |

OTHER PUBLICATIONS

R. Schlinker et al., "Enhancement of Directional Microphone," AIAA Paper No. 73-1040, Oct. 15, 1973.

F. Grosche et al., "On Aero Acoustic Measurements", AIAA, 1976.

L. Knox, "Underwater Detection", IBM Tech. Discl. Bull., Nov. 1961.

*Primary Examiner*—Kathleen H. Claffy

*Assistant Examiner*—E. S. Kemeny

*Attorney, Agent, or Firm*—Monte F. Mott; John R. Manning; Paul F. McCaul

[57] ABSTRACT

Apparatus for enhancing the resolution of a sound detector of the type which includes an acoustic mirror for focusing sound from an object onto a microphone to enable the determination of the location from which the sound arises. The enhancement apparatus includes an enclosure surrounding the space between the mirror and microphone, and containing a gas heavier than air, such as Freon, through which sound moves slower and therefore with a shorter wavelength than in air, so that a mirror of given size has greater resolving power. An acoustically transparent front wall of the enclosure which lies forward of the mirror, can include a pair of thin sheets with slightly pressured air between them, to form an end of the region of heavy gas into a concave shape.

10 Claims, 3 Drawing Figures

RESOLUTION ENHANCED SOUND DETECTING APPARATUS

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

This invention relates to sound detecting apparatus.

The detection of the precise location at which noise is created, can aid in the improvement of a variety of devices, such as machine tools and air frames. For example, the design of an airframe or portion thereof, can be aided by placing a model in a wind tunnel to flow air over it, and scanning the model to determine locations that generate noise. An identification of the noise power as well as its precise location can provide a basis for determining whether relatively minor geometrical changes can reduce airframe noise. The detection of the noise can be accomplished by utilizing a large acoustic mirror facing a potential noise source, and utilizing the mirror to concentrate sound onto a microphone. However, the directionality or resolution of the mirror is limited by defraction effects arising from the fact that the wavelengths of noise of interest may not be small in comparison to the diameter of the mirror. A typical mirror utilized in this work is one meter in diameter. Although the resolution would be increased by increasing the mirror diameter, this would result in an unwieldy system because of the increased size and because the mirror must be supported upon a steerable structure for precisely orienting the mirror. Apparatus which allowed mirrors of relatively modest size to be utilized but which increase the resolution of such mirrors, would enable the more accurate determination of the locations from which sounds arise.

SUMMARY OF THE INVENTION

In accordance with one embodiment of the present invention, a sound detecting apparatus is provided which increases the effective acuity of a sound-detecting mirror of predetermined size. The apparatus includes an enclosure about the mirror, which holds a heavy fluid such as gaseous Freon, which is heavier than the fluid such as air in the environment. The heavy fluid or gas, transmits sound at a lower velocity than is transmitted by the air of the environment, so that the sound waves passing through the heavy gas have a smaller wavelength than in air. The smaller wavelength of the sound reaching the mirror results in a mirror of given size having greater resolution, so that slight changes in the direction in which the mirror is aimed results in a greater change in the output of the microphone, to enable more accurate determination of the precise location from which the sound originates.

In order to keep in the heavy gas, a thin sheet of acoustically transparent material is fastened in place in front of the microphone. To prevent outward bulging of the bottom of the thin sheet by the heavy gas, when the mirror is oriented to face horizontally, a pair of thin sheets can be provided to seal in the gas. Air under a slight pressure is contained between the sheets, so that the sheet which is in contact with the heavy gas, bulges inwardly towards the mirror. The sheet can be constructed so that it deforms to a shape wherein sound waves pass through the sheet in a direction perpendicular to the sheet surface at all locations, to minimize acoustic wave distortion.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
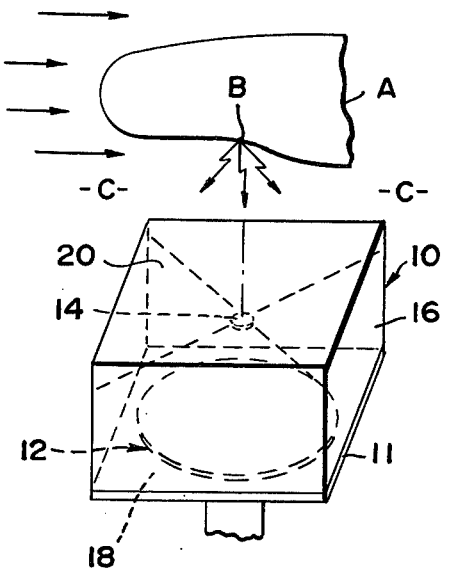
FIG. 1 is a perspective view of a sound detecting apparatus constructed in accordance with one embodiment of the present invention, showing its use in detecting sound produced by an airframe.

FIG. 1 illustrates an airframe A being tested in a wind tunnel wherein air flowing over the airframe results in the generation of noise at a location B. A sound detector 10, mounted on a steerable structure 11, is utilized to detect the sound and determine the precise location B on the airframe from which the sound originates. This information is useful in indicating where modifications of the airframe geometry should be made to reduce the noise levels and perhaps the drag or other undesirable effects resulting from the generation of noise power. A sound detector 10 for detecting the noise includes a concave mirror 12 and a microphone 14. The mirror 12 is aimed at the noise source, and concentrates the noise onto the microphone 14 which is connected to analyzing circuitry (not shown). Where relatively low pitched noise is to be detected, wherein the wavelength of the sound in air is large, a very large mirror would be required to provide high resolution so as to enable precise aiming of the mirror at the noise source. However, mirrors of more than about one meter in diameter become unwieldy.

In accordance with the present invention, an enclosure 16 is provided which surrounds the region between the mirror 12 and the microphone 14, and which contains a retarding fluid medium 18 that transmits sound at a lower velocity than in the surrounding atmosphere C. In the case of a wind tunnel, the atmosphere C surrounding the noise source B is air, and the fluid 18 may be a heavy gas such as Freon or sulphur hexafluoride which transmits sound at a much lower velocity than does air. A gas having a considerably greater density than air when at the same pressure, will have a lower acoustic velocity and may be used. The lower sound velocity in the medium 18 results in sound of a given frequency having a smaller wavelength than in air. Since the acuity of the mirror depends on the size of the mirror with respect to the size of the wavelength which it must reflect, the smaller wavelength results in a mirror of given size having greater resolving power in the small acoustic velocity medium 18 than it would have in the environment at C.

In order to prevent the escape of the medium 18, which may be a heavy gas, from the enclosure 16, the enclosure is provided with a wall 20 lying forward of the mirror 12 and which also may lie forward of the microphone 14. In order to minimize refraction and reflection of sound by the wall 20, it is preferably constructed of a very thin sheet of material such as a quarter mil (thousandths of an inch) sheet of tough material such as Mylar. However, such a thin sheet can easily deflect, and if the sound detector is oriented in an upright position with the axis 22 of the mirror 12 oriented horizontally, then the effect of gravity on a heavy gas in the enclosure will cause the bottom of the sheet 20 to bulge outwardly. Since the enclosed medium 18 has refractive powers, such a bulging would cause it to deflect the incoming sound waves in a way that would be very difficult to correct. Accordingly, when a simple sheet 20 is utilized, such distortions can be avoided by orienting the sound detector so that the axis 22 of the mirror is vertical.

Figure 2:
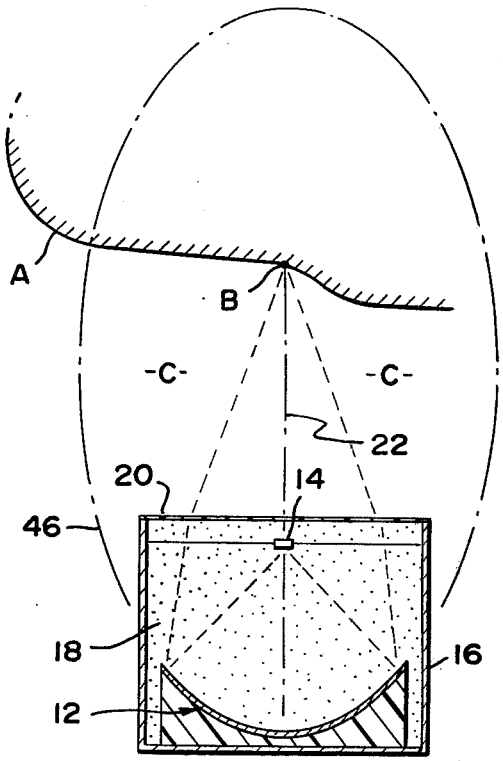
FIG. 2 is a sectional side view of the apparatus of FIG. 1.
Figure 3:
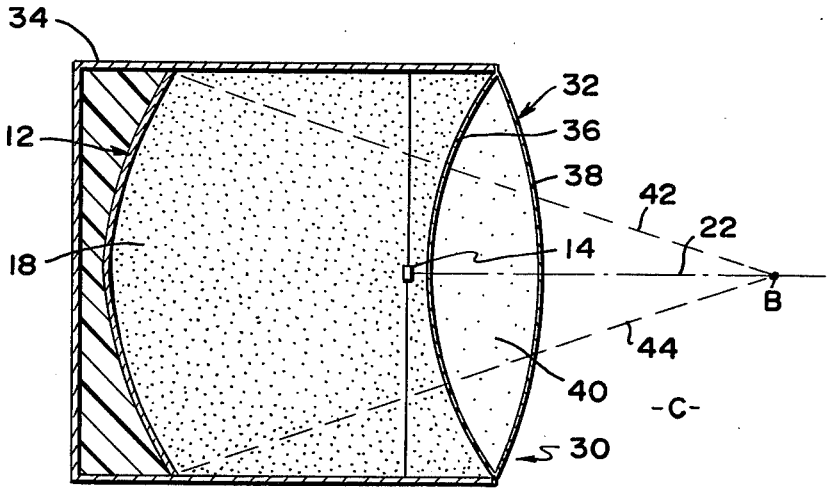
FIG. 3 is a sectional side view of a sound detecting apparatus constructed in accordance with another embodiment of the invention.

FIG. 3 illustrates another sound detector 30 which is similar to that of FIGS. 1 and 2, except that the front wall means 32 of its enclosure 34 is constructed so that the apparatus can be oriented with the mirror axis 22 horizontal or in any other position, without distortions. This is accomplished by utilizing two thin sheets 36, 38 for the forward wall means and by utilizing pressured air 40 or the like between the sheets. The pressured air 40 causes the sheets 36, 38 to bulge away from one another so that they are under tension, and therefore can hold a predetermined shape in spite of small forces applied to them as by the retarding fluid 18 in the enclosure. With the pressurizing fluid 40 between the sheets being the same as the fluid C in the environment, the "lens" formed by the fluid 40 does not affect sound waves passing therethrough from the environment C to the inside of the enclosure where the retarding fluid 18 is located. It is possible to utilize an extremely light or an extremely heavy pressurizing fluid and take any distortions into account, the corrections for such distortions being relatively simple since the surfaces of the two sheets 36, 38 can be maintained in simple shapes such as portions of spheres. Both sheets 36, 38 are preferably thin, such as ¼ mil thick Mylar, to minimize the attenuation of sound waves.

The sound detector 30 can be configured to not only avoid additional distortions that would arise from deviation from the flat sheet 20 of FIG. 2, but also to eliminate distortions arising from the sheet 20 being flat. This is accomplished by forming the innermost sheet 36 so that it is a portion of a sphere concentric with the point B from which the noise originates. This results in all sound waves such as those moving along the paths 42, 44, passing perpendicular to the surface of the sheet 36. When the sound waves pass from the air, between the sheets 36, 38, and then into the regarding medium 18, there would be a refraction of the waves if they were moving in any direction other than perpendicular to the intersection of air and the retarding medium at the sheet 36. In the case of a flat sheet such as that shown at 20 in FIG. 2, there are distortions resulting from the fact that the sound waves do not pass perpendicular to the interface between the retarding medium 18 and the air medium C, but the distortions are of known magnitudes and can be accounted for. In the apparatus of FIG. 3, there are no refractions of the sound waves as they pass into the medium 18, and therefore no corrections have to be made, so that a simpler apparatus can be utilized. In practice, the sound detector is positioned a predetermined distance from the approximate location of the noise source B wherein the source is approximately concentric with the inner sheet 36, and then the sound detector is scanned slightly sidewardly and vertically to pinpoint the exact location of the source.

The surface of the concave mirror 12 is preferably formed as a portion of ellipsoid 46 with the microphone 14 positioned at one focal point of the ellipse, and the sound detector positioned so that the sound source B is approximately at the other focal point of the ellipse. This can produce a very accurate determination of the location of the sound source B.

Thus, the invention provides a sound detecting apparatus which increases the resolution of an acoustic mirror of given size. This is accomplished by utilizing an enclosure surrounding the region immediately in front of the mirror, which contains a fluid that transmits sound at a lower velocity than the fluid in the environment from which the sound originates. In the case of a noise source located in air, a heavy gas such as Freon or sulphur hexafluoride may be utilized. In the case of sound originating in water or other liquid medium, a liquid which transmits sound at a lower velocity or a gas could be utilized as the retarding medium. Distortions of the interface between the retarding medium and the environment, can be minimized while the detecting apparatus is at any orientation, by utilizing a double sheeted structure for the forward wall means of the enclosure, and by utilizing a pressured medium in the enclosure, which may be the same fluid as is in the environment. The innermost sheet of the double-walled arrangement can be formed so it is convex to a location at which the sound source will be located, to substantially eliminate the need for any corrections arising from the sound waves not passing perpendicular to the interface between the retarding medium and the environmental medium.

Although particular embodiments of the invention have been described and illustrated herein, it is recognized that modifications and variations may readily occur to those skilled in the art, and consequently, it is intended that the claims be interpreted to cover such modifications and equivelents.

I claim:

1. Sound detecting apparatus for detecting sound moving in an environment containing a first fluid, comprising:

a concave acoustic mirror;

a microphone positioned in front of said mirror, so that sound impinging on said mirror can be concentrated by it onto said microphone;

an enclosure positioned to enclose at least some of the space lying between said mirror and microphone, including the space immediately in front of the mirror; and a quantity of second fluid disposed in said enclosure, said second fluid being of a type which carries sound at a lower speed than does said first fluid, whereby to decrease the wavelength of sound to increase the resolution of said mirror.

2. The apparatus described in claim 1 wherein:

said first fluid in the environment is air; and said second fluid is a gas of greater density than air when at the same pressure as air.

3. The apparatus described in claim 2 wherein:

said second fluid is Freon.

4. The apparatus described in claim 1 wherein:

said second fluid has a different density than said first fluid;

said enclosure comprises a thin sheet of material lying in front of said mirror; and said mirror faces vertically and said thin sheet lies over said mirror.

5. The apparatus described in claim 1 wherein:

said enclosure comprises a plurality of walls, including a front wall formed by a pair of thin sheets of material lying substantially in front of said mirror, and a quantity of fluid of a type which carries sound at a higher speed than said second fluid and which is at a higher pressure than the pressure in the environment, disposed between said sheets to press them apart.

6. The apparatus described in claim 1 wherein:

said enclosure comprises a thin sheet of material lying in front of said mirror, said sheet of material formed in a bulge wherein the middle of the sheet is closer to the mirror than it would be if the sheet were flat, whereby to minimize distortions, by reason of passage through the sheet, of sound emanating from a nearby source.

7. Acoustic apparatus for controlling the movement of sound between a transducer and an object located in air, comprising:

an acoustic mirror;

a sound transducer positioned in front of said mirror;

an enclosure disposed about at least some of the volume lying between said mirror and said transducer; and a gas that transmits sound at a lower speed than does air, disposed in said enclosure.

8. The apparatus described in claim 7 wherein:

said enclosure includes a plurality of walls, one of said walls formed by a pair of thin sheets in front of the mirror, and a gas under a higher pressure than ambient pressure, disposed between said sheets.

9. A method for increasing the directionality of a mirror-microphone system wherein the mirror can be aimed to try to determine the precise location of a sound source in the environment, by sensing the output of the microphone which is mounted along the axis of the mirror, comprising:

enclosing said mirror-microphone system; and establishing a sound-transmission medium which carries sound at a lower speed than the fluid in the environment, in said enclosure.

10. A method for increasing the directionality of a mirror-microphone system wherein the mirror can be aimed to try to determine the precise location of a sound source in the environment, by sensing the output of the microphone which is mounted along the axis of the mirror, comprising:

enclosing said mirror-microphone system in an enclosure and positioning said system, wherein said mirror is a portion of an ellipsoid, said microphone is positioned at one focal point of the ellipsoid, and the sound source lies on the other focal point of the ellipsoid; and establishing a sound-transmission medium which carries sound at a lower speed than the fluid in the environment, in most of the space between the mirror and microphone;

said step of enclosing including establishing a thin sound-transmitting wall in front of said mirror at a surface of the enclosure furthest from the mirror, wherein the wall is at a curvature and position so that sound waves originating from said other focal point and moving toward said mirror, pass perpendicular to said thin wall.

* * * * *